US005953775A

United States Patent [19]

Mauro et al.

[11] Patent Number: 5,953,775

[45] Date of Patent: Sep. 21, 1999

[54] UNITARY BODY BEDDING FOUNDATION

[76] Inventors: Frank Mauro, 78 Malabar Cres, Brampton, Ontario, Canada, L6S 3X8; Fausto Mauro, 99 Columbus Avenue, Woodbridge, Ontario, Canada, L4L 7H1; Vito Mauro, 9 Massey Street, Brampton, Ontario, Canada, L6S 2V6

[21] Appl. No.: 08/816,516

[22] Filed: Mar. 13, 1997

[51] Int. Cl.[6] ..... A47C 19/00; A47C 19/02

[52] U.S. Cl. ..... 5/201; 5/400

[58] Field of Search ..... 5/400, 201, 200.1, 5/186.1, 203

[56] References Cited

U.S. PATENT DOCUMENTS

| | | | |
|---|---|---|---|
| 2,924,830 | 2/1960 | De Long | 5/8 |
| 3,049,729 | 8/1962 | Broyles | 5/200.1 |
| 3,083,380 | 4/1963 | Adler | 5/727 |
| 3,656,193 | 4/1972 | Schneider et al. | 5/655 |
| 3,815,165 | 6/1974 | Tobinick et al. | 5/680 |
| 4,128,907 | 12/1978 | Gelbart | 5/201 |
| 4,970,743 | 11/1990 | Wride et al. | 5/400 |
| 5,469,589 | 11/1995 | Steed et al. | 5/201 |

FOREIGN PATENT DOCUMENTS

| | | | |
|---|---|---|---|
| 2223952 | 10/1974 | France | 5/400 |
| 2 547 185 | 12/1984 | France . | |

*Primary Examiner*—Alex Grosz

[57] ABSTRACT

A new Unitary Body Bedding Foundation for constructing the top deck portion, the end walls and the side walls are all as a single piece. The inventive device includes a top deck member having two spaced apart side walls and two spaced apart end walls on its bottom face. The side walls and the end walls may designed to be detachable from the top deck member. To aid in supporting the top deck member, the unitary body bed foundation may also include a support frame member adjacent the bottom face of the top deck member. The support frame member can be either a lattice support frame member having a plurality of longitudinal and latitudinal intersecting ribs included on the bottom face, or at least one lateral slat extended transversely between the two side walls and the ends of each lateral slat being accepted by a slat brace on each of the side walls.

17 Claims, 3 Drawing Sheets

UNITARY BODY BEDDING FOUNDATION

BACKGROUND OF THE INVENTION

1. Field of the Invention

The present invention relates to bedding foundations or bed frames and more particularly pertains to a new Unitary Body Bedding Foundation for constructing the top deck portion, the end walls and the side walls are all as a single piece.

2. Description of the Prior Art

Bedding foundations or box springs frames have traditionally been manufactured using wood and wood by-products. Once the main structural box is completed, a fabric cover is added to conceal open areas and to match the fabric of the supported mattress. A manufacturer using wood as a material is constantly faced with the prospects of rising prices, decreasing supply and the risk of using inferior grades of wood. A plastic bedding foundation can be made as a single unit and solves the problems of using wood for bedding foundations.

The use of bedding foundations is known in the prior art. More specifically, bedding foundations heretofore devised and utilized are known to consist basically of familiar, expected and obvious structural configurations, notwithstanding the myriad of designs encompassed by the crowded prior art which have been developed for the fulfillment of countless objectives and requirements.

Known prior art bedding foundations include U.S. Pat. No. 4,870,711; U.S. Pat. No. 4,535,494; U.S. Pat. Des. 316,202; U.S. Pat. No. 5,144,706; U.S. Pat. No. 5,231,714; and U.S. Pat. No. 4,181,991.

While these devices fulfill their respective, particular objectives and requirements, the aforementioned patents do not disclose a new Unitary Body Bedding Foundation. The inventive device includes a top deck member having two spaced apart side walls and two spaced apart end walls on its bottom face. The side walls and the end walls may designed to be detachable from the top deck member. To aid in supporting the top deck member, the unitary body bed foundation may also include a support frame member adjacent the bottom face of the top deck member. The support frame member can be either a lattice support frame member having a plurality of longitudinal and latitudinal intersecting ribs included on the bottom face, or at least one lateral slat extended transversely between the two side walls and the ends of each lateral slat being accepted by a slat brace on each of the side walls.

In these respects, the Unitary Body Bedding Foundation according to the present invention substantially departs from the conventional concepts and designs of the prior art, and in so doing provides an apparatus primarily developed for the purpose of constructing the top deck portion, the end walls and the side walls are all as a single piece.

SUMMARY OF THE INVENTION

In view of the foregoing disadvantages inherent in the known types of bedding foundations now present in the prior art, the present invention provides a new Unitary Body Bedding Foundation construction wherein the same can be utilized for constructing the top deck portion, the end walls and the side walls are all as a single piece.

The general purpose of the present invention, which will be described subsequently in greater detail, is to provide a new Unitary Body Bedding Foundation apparatus and method which has many of the advantages of the bedding foundations mentioned heretofore and many novel features that result in a new Unitary Body Bedding Foundation which is not anticipated, rendered obvious, suggested, or even implied by any of the prior art bedding foundations, either alone or in any combination thereof.

To attain this, the present invention generally comprises a top deck member having two spaced apart side walls and two spaced apart end walls on its bottom face. The side walls and the end walls may designed to be detachable from the top deck member. To aid in supporting the top deck member, the unitary body bed foundation may also include a support frame member adjacent the bottom face of the top deck member. The support frame member can be either a lattice support frame member having a plurality of longitudinal and latitudinal intersecting ribs included on the bottom face, or at least one lateral slat extended transversely between the two side walls and the ends of each lateral slat being accepted by a slat brace on each of the side walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Unitary Body Bedding Foundation apparatus and method which has many of the advantages of the bedding foundations mentioned heretofore and many novel features that result in a new Unitary Body Bedding Foundation which is not anticipated, rendered obvious, suggested, or even implied by any of the prior art bedding foundations, either alone or in any combination thereof.

It is another object of the present invention to provide a new Unitary Body Bedding Foundation which may be easily and efficiently manufactured and marketed.

It is a further object of the present invention to provide a new Unitary Body Bedding Foundation which is of a durable and reliable construction.

An even further object of the present invention is to provide a new Unitary Body Bedding Foundation which is susceptible of a low cost of manufacture with regard to both materials and labor, and which accordingly is then susceptible of low prices of sale to the consuming public, thereby making such Unitary Body Bedding Foundation economically available to the buying public.

Still yet another object of the present invention is to provide a new Unitary Body Bedding Foundation which provides in the apparatuses and methods of the prior art some of the advantages thereof, while simultaneously overcoming some of the disadvantages normally associated therewith.

Still another object of the present invention is to provide a new Unitary Body Bedding Foundation for constructing the top deck portion, the end walls and the side walls are all as a single piece.

Yet another object of the present invention is to provide a new Unitary Body Bedding Foundation which includes a top deck member having two spaced apart side walls and two spaced apart end walls on its bottom face. The side walls and the end walls may designed to be detachable from the top deck member. To aid in supporting the top deck member, the unitary body bed foundation may also include a support frame member adjacent the bottom face of the top deck member. The support frame member can be either a lattice support frame member having a plurality of longitudinal and latitudinal intersecting ribs included on the bottom face, or at least one lateral slat extended transversely between the two side walls and the ends of each lateral slat being accepted by a slat brace on each of the side walls.

Still yet another object of the present invention is to provide a new Unitary Body Bedding Foundation that is constructed out of a combination of new and recycled plastic rather than the traditional wood foundation so that it does not creak, and is unaffected by moisture, and its structural strength is not weakened through use unlike the traditional wood bed foundation.

Even still another object of the present invention is to provide a new Unitary Body Bedding Foundation that is constructed so that it may be dismantled for shipping in more convenient packaging.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
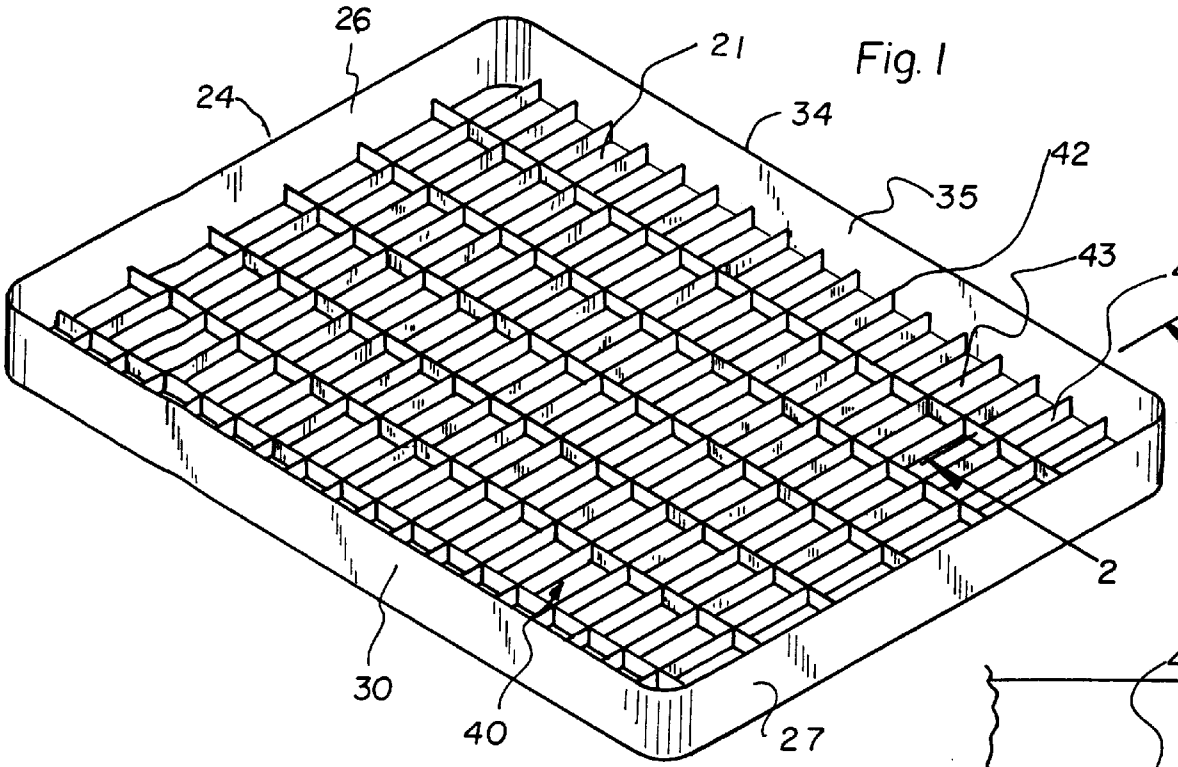
FIG. 1 is a bottom perspective view of a new Unitary Body Bedding Foundation according to the present invention showing the lattice support frame member.
Figure 2:
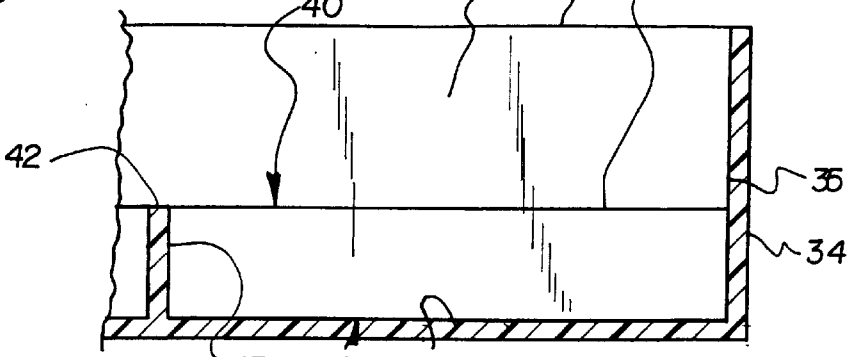
FIG. 2 is a partial cross-sectional view of the present invention taken along line 2—2 of FIG. 1.
Figure 4:
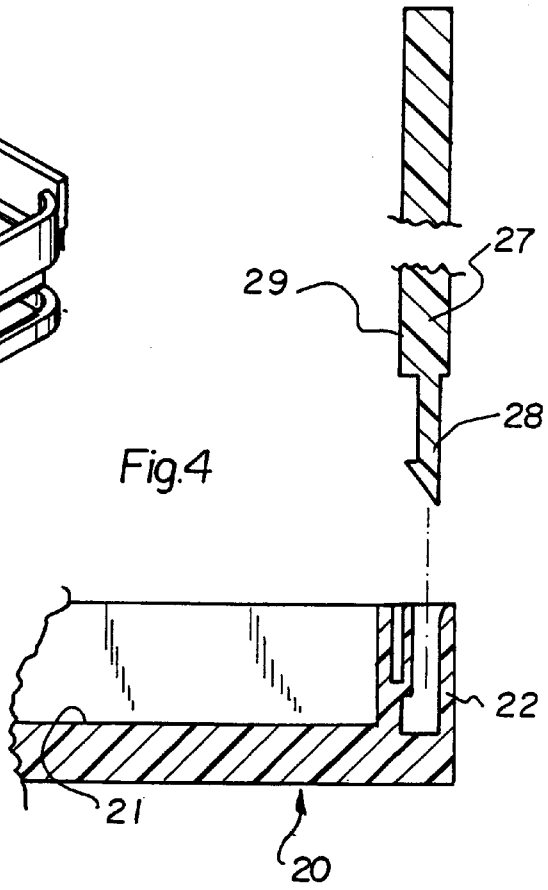
FIG. 4 is a partial cross-sectional view taken from line 4—4 of FIG. 3 showing the detail of the insertion of the top deck attachment portion into the side wall slot of the top deck member.

With reference now to the drawings, and in particular to FIGS. 1 through 6 thereof, a new Unitary Body Bedding Foundation embodying the principles and concepts of the present invention and generally designated by the reference numeral 20 will be described.

As best illustrated in FIGS. 1 through 6, the Unitary Body Bedding Foundation 10 comprises a rectangular shaped top deck member 10 that can be made to any dimension. The top deck member 10 is designed to be of sufficient size so it can support a mattress upon it. On the outer perimeter of its bottom face 21 are a pair of similarly aligned and spaced apart side walls 30,34 and a pair of similarly aligned and spaced apart end walls 24,27.

Figure 3:
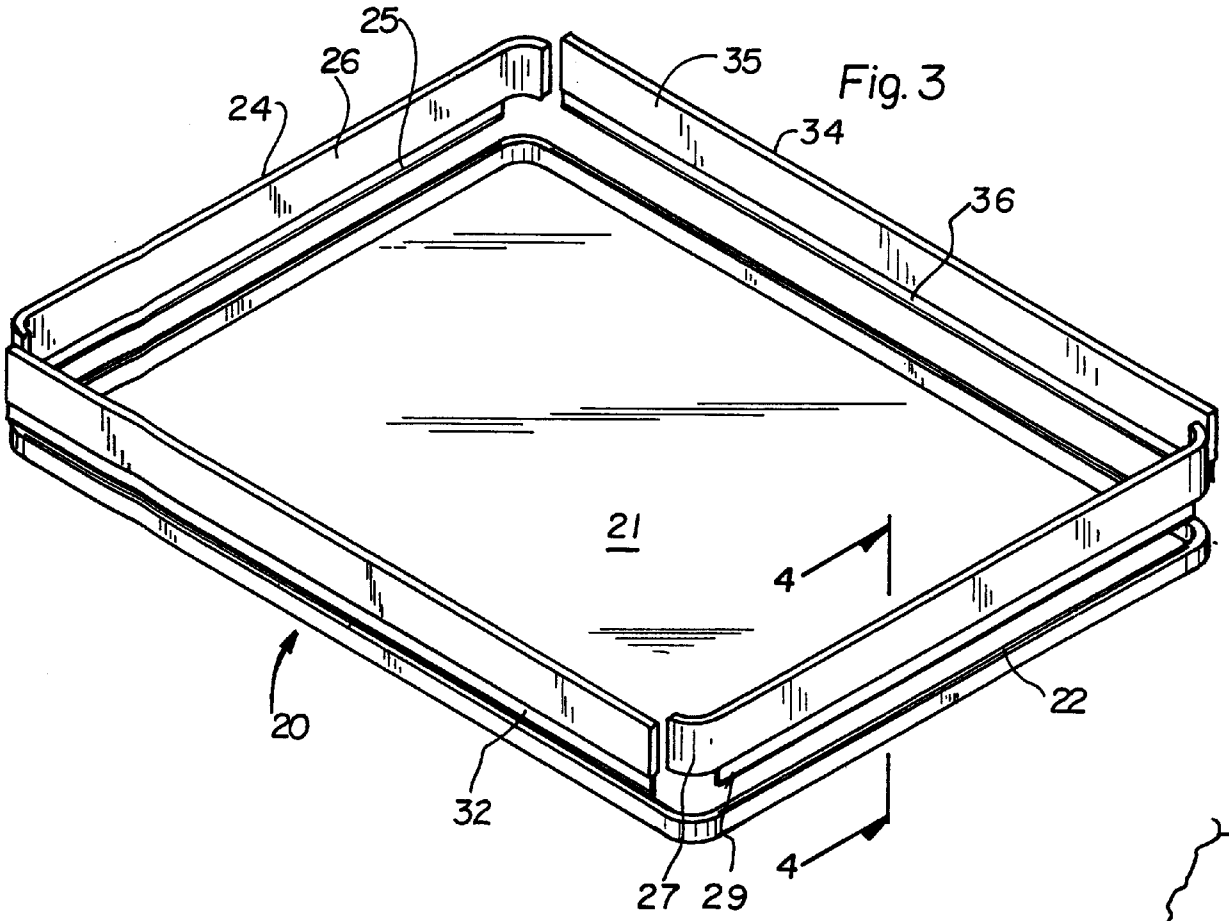
FIG. 3 is a exploded perspective view of the present invention having detachable side walls and end walls.

In FIG. 1, the end walls 24,27 and the side walls 30,34 are designed as an integral part of the top deck member 20. Optionally as shown in FIG. 3, the side walls 30,34 and the end walls 24,27 may be detachable from the top deck member 10. In this embodiment of the invention, each of the side walls 30,34 includes a top deck attachment portion 32,36 extending along its length. Similarly, each of the end walls 24,27 has a top deck attachment portion 25,28 extending along its length. Correspondingly, the top deck member 20 has a side wall attachment slot or slots 22 extending around the outer perimeter of its bottom face 21. The top deck attachment portions 25,28,32,36 are inserted into and accepted by the attachment slot or slots 22 at the top deck attachment portions' 25,28,32,36 respective position on the bottom face 21.

Figures 5, 6:
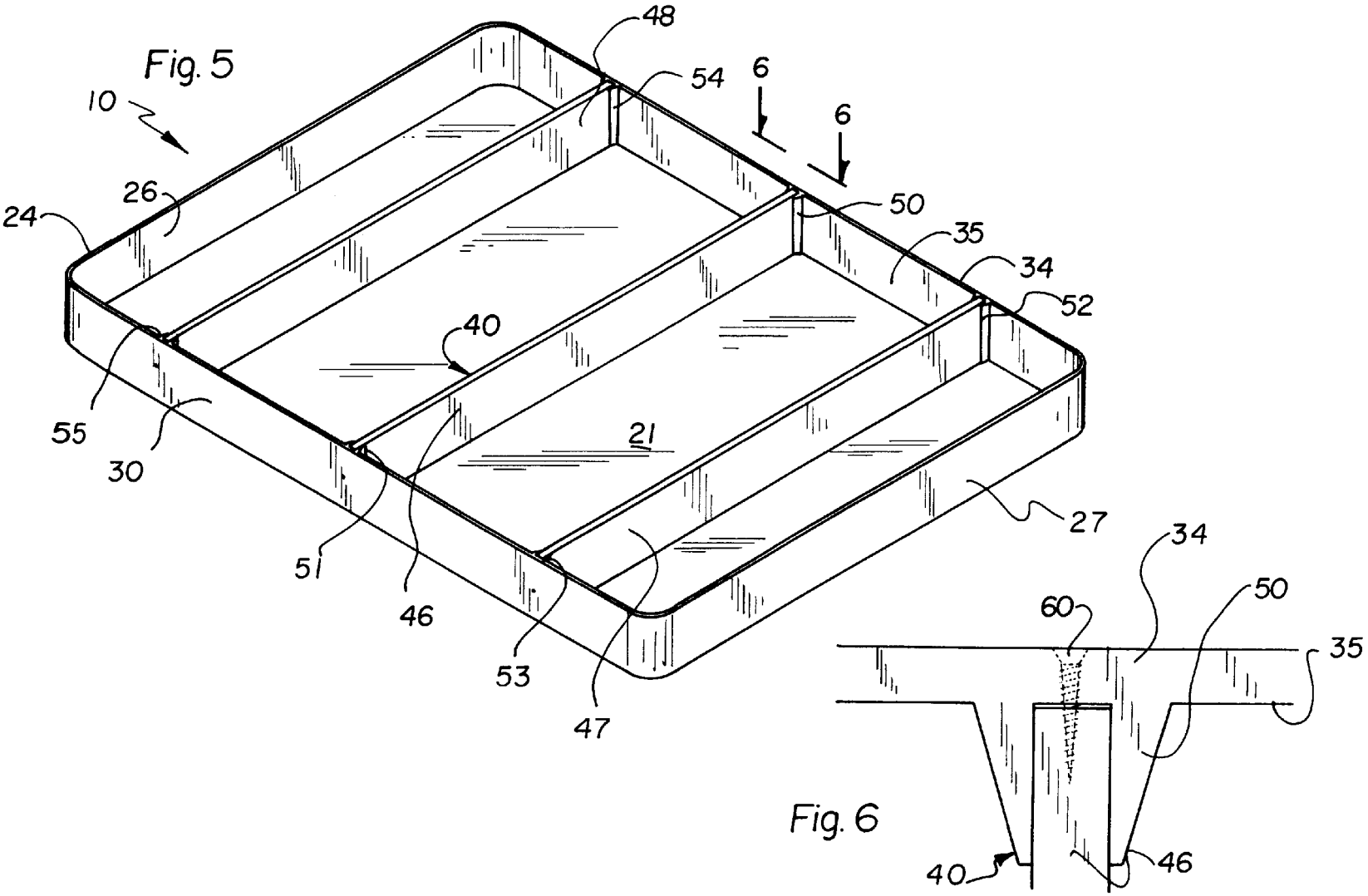
FIG. 5 is a perspective view of the showing a version of the unitary body bed foundation with lateral slats extending transversely between the side walls.
FIG. 6 is a partial sectional view showing the relationship of the slat brace and the end of a lateral slat as seen from line 6—6 on FIG. 5.

The top deck member 20 may be designed to be of sufficient thickness to support a mattress on its top face (not shown) on its own. However, as shown in FIGS. 1 and 5, a support frame member 40 positioned adjacent the bottom face 21 to provide additional strength and support to the top deck member 20.

As shown in FIG. 1, one embodiment of the unitary body bed foundation 10 has a support frame member 40 comprising a lattice support frame member 42 included as integral part of the bottom face 21 of the top deck member 20. The lattice support frame member 42 is comprised of a plurality of spaced apart longitudinal rib members 43 being intersected by a plurality of spaced apart latitudinal rib members 44. The lateral rib members 44 extend transversely between the interior faces 35 of the side walls 30,34 while the longitudinal rib members 43 extend transversely between the interior faces 26,29 of the end walls 24,27.

Another optional variant of support frame member 40 comprises at least one lateral slat 46,47,48 where each lateral slat 46,47,48 is positioned adjacent to the bottom face 21 of the top deck member 20 and extended transversely between the side walls 30,34 so each of its ends is adjacent one of the interior faces 35 of the side walls 30,34. On each of the interior faces 35 of the side walls 30,34 there is a U-shaped slat brace 50,51,52,53,54,55 for each lateral slat

46,47,48. As shown in FIG. 5, the slat braces 51,53,55 on one side wall 30 may be in alignment with their corresponding slat brace 50,52,54 on the other side wall 34. Each slat brace 50,51,52,53,54,55 accepts one end of each lateral slat 46,47,48 so that the slats 46,47,48 are attached to the side walls 30,34. For further strength and stability, the ends of each lateral slat 46,47,48 may be coupled to its respective slat braces 50,51,52,53,54,55 and the side walls 30,34 by a fastener 60 such as a threaded screw.

In manufacturing the unitary body bed foundation 10, the top deck member 20, the side walls 30,34, the end walls 24,27, the support frame member 40, and the lattice support frame member 42 may be made of plastic. As an example, the plastic may be made of a combination of polyolefins, linear low density polyethylene, low density polyethylene, high density polyethylene, polypropylene, polyethylene terephthalate. The plastics may also be a combination of virgin plastics and recycled plastics. The plastic may also include other additives such as fire retardants, stabilizers, and color pigments. The elements of the unitary body bed foundation 10 may be manufactured using compression molding, injection molding or thermoforming. Additionally, the lateral slats 46,47,48 may be made of metal, wood or of plastic as described above.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A unitary body bed foundation, comprising:

a top deck member having a bottom face and an upper edge with a slot therein;

a pair of side walls detachably mounted to said top deck member in a parallel and spaced apart relationship to each other, each of said side walls having a lower edge with a tongue mounted thereon adapted for insertion into said slot of said top deck member;

a pair of end walls detachably mounted to said top deck member in a parallel and spaced apart relationship to each other, each of said end walls having a lower edge with a tongue mounted thereon adapted for insertion into said slot of said top deck member.

2. The unitary body bed foundation of claim 1, additionally comprising a support frame member positioned adjacent said bottom face of said top deck member for providing additional support to said top deck member, and wherein said support frame member is a lattice support frame member on said bottom face of said top deck member, said lattice frame member extending between said side walls and extending between said end walls.

3. The unitary body bed foundation of claim 2, wherein said lattice support frame member includes a plurality of spaced apart longitudinal rib members and a plurality of spaced apart latitudinal rib members, said latitudinal rib members intersecting said longitudinal rib members, said longitudinal rib members being extended between said end walls and said latitudinal rib members being extended between said side walls.

4. The unitary body bed foundation of claim 2, wherein said support frame member comprises at least one lateral slat having a first end and a second end and wherein said side walls each having a least one slat brace for each said lateral slat, each said lateral slat extending transversely between said side walls and being positioned adjacent to said bottom face of said top deck member, said first end of each said lateral slat being accepted by each said slat brace of one of said side walls, and said second end of each said lateral slats being accepted by each said slat brace of the other of said side walls.

5. The unitary body bed foundation of claim 4, wherein each said slat brace of one said side walls is substantially aligned with each said slat brace of the other of said side walls.

6. The unitary body bed foundation of claim 4, wherein said first end of each said lateral slat is coupled to each said slat brace of one of said side walls by means of a fastener and wherein said second end of each said lateral slat is coupled to each said slat brace of the other of said side walls by means of a fastener.

7. The unitary body bed foundation of claim 4, wherein each said lateral slat is made of metal, wood or plastic.

8. The unitary body bed foundation of claim 1, wherein said top deck member, said side walls, said end walls, and said support frame member are made of plastic.

9. A unitary body bed foundation comprising:

a top deck member having a bottom face, a pair of side walls, and a pair of end walls, said side walls being spaced apart, said end walls being spaced apart; and a support frame member being positioned adjacent said bottom face of said top deck member, said support frame for providing additional support to said top deck member;

wherein said side walls and said end walls are detachable from said top deck member; and wherein said side walls each include a top deck attachment portion, said end walls each having a top deck attachment portion, said top deck member having at least one side wall attachment slot being extended around the outer perimeter of its bottom face, and wherein said attachment slot accepting said top deck attachment portion of said side walls and accepting said top deck attachment portion of said end walls.

10. The unitary body bed foundation of claim 9, wherein said support frame member comprises at least one lateral slat having a first end and a second end and wherein said side walls each have a least one slat brace for each said lateral slat, each said lateral slat extending transversely between said side walls and being positioned adjacent to said bottom face of said top deck member, said first end of each said lateral slat being accepted by each said slat brace of one of said side walls, and said second end of each said lateral slats being accepted by each said slat brace of the other of said side walls.

11. The unitary body bed foundation of claim 10, wherein each said slat brace of one said side walls is substantially aligned with each said slat brace of the other of said side walls.

12. The unitary body bed foundation of claim 10, wherein said first end of each said lateral slat is coupled to each said slat brace of one of said side walls by means of a fastener and wherein said second end of each said lateral slat is coupled to each said slat brace of the other of said side walls by means of a fastener.

13. The unitary body bed foundation of claim 10, wherein each said lateral slat is made of metal, wood or plastic.

14. The unitary body bed foundation of claim 9, wherein said top deck member, said side walls, said end walls, and said support frame member are made of plastic.

15. The unitary body bed foundation of claim 9, wherein said support frame member is a lattice support frame member on said bottom face of said top deck member, said lattice frame member extending between said side walls and extending between said end walls.

16. The unitary body bed foundation of claim 15, wherein said lattice support frame member includes a plurality of spaced apart longitudinal rib members and a plurality of spaced apart latitudinal rib members, said latitudinal rib members intersecting said longitudinal rib members, said longitudinal rib members being extended between said end walls and said latitudinal rib members being extended between said side walls.

17. A unitary body bed foundation comprising:

a top deck member having a bottom face, a pair of side walls, and a pair of end walls, said side walls being spaced apart, said end walls being spaced apart; and a support frame member being positioned adjacent said bottom face of said top deck member, said support frame for providing additional support to said top deck member;

wherein said side walls and said end walls are detachable from said top deck member; and wherein said side walls each include a top deck attachment portion, said end walls each having a top deck attachment portion, said top deck member having at least one side wall attachment slot being extended around the outer perimeter of its bottom face, and wherein said attachment slot is adapted to accept said top deck attachment portion of said side walls and is adapted to accept said top deck attachment portion of said end walls;

wherein said support frame member is comprised of at least one lateral slat having a first end and a second end and wherein said side walls each have a least one slat brace for each said lateral slat, each said lateral slat being extended transversely between said side walls and being positioned adjacent to said bottom face of said top deck member, said first end of each said lateral slat being accepted by each said slat brace of one of said side walls, and said second end of each said lateral slats being accepted by each said slat brace of the other of said side walls;

wherein each said slat brace of one said side walls is substantially aligned with each said slat brace of the other of said side walls;

wherein said first end of each said lateral slat is coupled to each said slat brace of one of said side walls by means of a fastener and said second end of each said lateral slat is coupled to each said slat brace of the other of said side walls by means of a fastener;

wherein each said lateral slat is made of metal, wood or plastic; and wherein said top deck member, said side walls, said end walls, and said support frame member are made of plastic.

* * * * *